United States Patent [19]

Abel et al.

[11] Patent Number: 4,787,912

[45] Date of Patent: Nov. 29, 1988

[54] DYEING ASSISTANT AND USE THEREOF FOR DYEING OR WHITENING SYNTHETIC NITROGEN-CONTAINING FIBRE MATERIALS

[75] Inventors: Heinz Abel, Reinach; Helmut Raisin, Riehen, both of Switzerland

[73] Assignee: Ciba-Geigy Corporation, Ardsley, N.Y.

[21] Appl. No.: 8,022

[22] Filed: Jan. 28, 1987

[30] Foreign Application Priority Data

Jan. 31, 1986 [CH] Switzerland ..... 364/86

[51] Int. Cl.[4] ..... D06L 3/12; D06P 1/62; D06P 3/24; D06M 3/38

[52] U.S. Cl. ..... 8/582; 8/568; 8/585; 8/586; 8/587; 8/588; 8/578; 8/593; 8/602; 8/603; 8/609; 8/611; 8/648; 8/924; 8/929

[58] Field of Search ..... 8/557, 582, 588, 602, 8/648

[56] References Cited

U.S. PATENT DOCUMENTS

| | | | |
|---|---|---|---|
| 2,969,332 | 1/1961 | Lawler et al. | 252/354 |
| 3,628,905 | 12/1971 | Kirschnek et al. | 8/543 |
| 4,192,754 | 3/1980 | Marshall et al. | 252/8.8 |
| 4,283,292 | 8/1981 | Marshall et al. | 252/8.8 |
| 4,329,147 | 5/1982 | Harris | 8/636 |
| 4,408,995 | 10/1983 | Guth et al. | 8/477 |
| 4,620,976 | 11/1986 | Quack et al. | 252/545 |

OTHER PUBLICATIONS

C.A. 86:91670h Schwanzer, 1977, p. 108.

*Primary Examiner*—A. Lionel Clingman
*Attorney, Agent, or Firm*—Wenderoth, Lind & Ponack

[57] ABSTRACT

An assistant for dyeing or whitening synthetic nitrogen-containing fibre material, which comprises
(A) a sulfonated polycarboxylate,
(B) an anionic surfactant,
(C) a nonionic surfactant, and
(D) a water-soluble organic, polar solvent.

The assistant is especially useful for dyeing or whitening polyamide fibres.

10 Claims, No Drawings

DYEING ASSISTANT AND USE THEREOF FOR DYEING OR WHITENING SYNTHETIC NITROGEN-CONTAINING FIBRE MATERIALS

The present invention relates to a novel dyeing assistant and to the use thereof for dyeing or whitening synthetic nitrogen-containing fibre materials, especially polyamide carpets.

The drawback of padding assistants used for dyeing nitrogen-containing fibre materials is that, when added in small amounts (ecological aspect), their wetting properties are unsatisfactory and they are entirely inadequate for treating nitrogen-containing fibres coated with polytetrafluoroethylene. For this reason it was hitherto necessary to use large amounts of wetting agents in the pretreatment, which then resulted in excessive retarding effects or unlevel dyeings.

Surprisingly, there has now been found a novel dyeing assistant which, even when used in small amount, has very good wetting properties and does not have the shortcomings referred to above. The novel assistant foams sufficiently strongly in the steamer to prevent a frosting effect. The small amount in which it is used keeps foaming at a low level when the goods are washed off and the environmental impact is correspondingly less.

Accordingly, the present invention relates to a dyeing assistant for use in dyeing or whitening synthetic nitrogen-containing fibre materials, which assistant comprises (A) a sulfonated polycarboxylate, (B) an anionic surfactant, (C) a nonionic surfactant, and (D) a water-miscible organic polar solvent.

In addition to components (A), (B), (C) and (D), the dyeing assistant of this invention may also contain water and (E) a thickener.

Preferred assistants comprise components (A), (B), (C), (D) and water.

Component (A) is preferably a sulfonated dicarboxylate, e.g. a bisalkyl sulfosuccinate containing 8 to 22 carbon atoms in each of the alkyl moieties, for example the bisoctyl sulfosuccinate, or also a sulfosuccinamide. These esters are preferably in the form of the alkali metal salts or ammonium salts.

The anionic surfactants (B) are preferably derivatives of alkylene oxide adducts, e.g. adducts of alkylene oxides, preferably of ethylene oxide and/or propylene oxide or also styrene oxide, with organic hydroxyl, carboxyl, amino and/or amido compounds containing aliphatic hydrocarbon radicals having a total of not less than 4 carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 1 mole, preferably of more than 1 mole, e.g. 2 to 60 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having not less than 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Examples of suitable anionic surfactants are:

- sulfated aliphatic alcohols which contain 8 to 18 carbon atoms in the alkyl chain, e.g. sulfated lauryl alcohol;
- sulfated unsaturated fatty acids or fatty acid lower alkyl esters which contain 8 to 20 carbon atoms in the fatty radical, e.g. ricinic acid and oils containing such fatty acids, e.g. castor oil;
- alkylsulfonates containing 8 to 20 carbon atoms in the alkyl chain, e.g. dodecylsulfonate;
- alkylarylsulfonates with linear or branched alkyl chain containing not less than 6 carbon atoms, e.g. dodecylbenzenesulfonates or 3,7-diisobutylnaphthalenesulfonates;
- the alkali metal salts, ammonium salts or amine salts of fatty acids containing 10 to 20 carbon atoms, e.g. rosin salts, classified as soaps;
- esters of polyalcohols, especially mono- or diglycerides of fatty acids containing 12 to 18 carbon atoms, e.g. monoglycerides of lauric, stearic or oleic acid; and
- the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid, e.g. maleic acid or sulfosuccinic acid, but preferably with an inorganic polybasic acid such as o-phosphoric acid or sulfuric acid.

Very suitable anionic surfactants (B) are acid esters, or salts thereof, of a polyadduct of 2 to 30 moles of ethylene oxide with 1 mole of a fatty alcohol containing 8 to 22 carbon atoms, or with 1 mole of a phenol which contains at least one benzyl group, one phenyl group or preferably one alkyl group containing at least 4 carbon atoms, e.g. benzylphenol, dibenzylphenol, dibenzyl(nonyl)phenol, o-phenylphenol, butylphenol, tributylphenol, octylphenol, nonylphenol, dodecylphenol or pentadecylphenol, which acid esters may be used individually or in admixture.

Preferred components (B) have the formula $$Y—O—(CH_2CH_2O—)_mX, \quad (1)$$

wherein Y is alkenyl or preferably alkyl of 8 to 22, preferably 8 carbon atoms, alkylphenyl containing 4 to 16 carbon atoms in the alkyl moiety, or o-phenylphenyl, X is the acid radical of an inorganic oxygen-containing acid, e.g. phosphoric acid or, preferably, sulfuric acid, or is also the radical of an organic acid, and m is 2 to 40, preferably 2 to 15. The alkyl moiety of alkylphenyl is preferably in the para-position, and may be butyl, hexyl, n-octyl, n-nonyl, p-tert-octyl, p-isononyl, decyl or dodecyl. Preferred alkyl radicals are those containing 8 to 12, preferably 8 or 9, carbon atoms.

The fatty alcohols for obtaining the anionic surfactants of formula (1) are e.g. those containing 8 to 22, preferably 8 to 18, carbon atoms, such as octyl, decyl, lauryl, tridecyl, myristyl, cetyl, stearyl, oleyl, arachidyl or behenyl alcohol. Lauryl alcohol is preferred.

The acid radical X is derived, for example, from a low molecular dicarboxylic acid, e.g. from maleic acid, succinic acid or sulfosuccinic acid, and is linked to the oxyethylene part of the molecule through an ester bridge. In particular, X is derived from an inorganic polybasic acid such as sulfuric acid and, in particular, orthophosphoric acid. The acid radical X can be in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Further preferred components (B) are anionic surfactants of formula

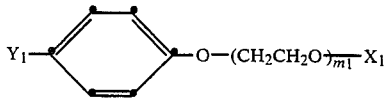

(2)

wherein $Y_1$ is octyl or nonyl, $m_1$ is 2 to 15, and $X_1$ is a radical derived from sulfuric acid or, preferably, from o-phosphoric acid, which surfactants are in the form of free acids or sodium or ammonium salts. A particularly preferred anionic surfactant is the phosphate ester of the adduct of 5 to 12 moles of ethylene oxide with 1 mole of p-nonylphenol.

The anionic surfactants (B) may be used by themselves or as mixtures with one another.

The nonionic surfactant (C) is an amine oxide of formula

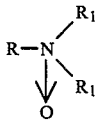

(3)

wherein R is alkyl of 8 to 22, preferably of 12 to 18, carbon atoms, and $R_1$ is $C_1$–$C_4$alkyl. $R_1$ is preferably methyl.

Examples of suitable water-miscible organic polar solvents (D) are: aliphatic $C_1$–$C_6$alcohols such as methanol, ethanol, the propanols or isobutanol; 1,3-butanediol or 1,2-propanediol; alkylene glycols such as ethylene glycol or propylene glycol; monoalkyl ethers of glycols such as ethylene glycol monomethyl, monoethyl or monobutyl ether; diethylene glycol monomethyl, monoethyl or monobutyl ether and tetraethylene glycol monobutyl ether; ketones such as acetone, methyl ethyl ketone, cyclohexanone, diacetone alcohol or 1-methyl-2-pyrrolidone; ethers and acetals such as diisopropyl ether, diphenyl oxide, dioxane, tetrahydrofuran, and also tetrahydrofurfuryl alcohol, pyridine, acetonitrile, γ-butyrolactone, N,N-di-methylformamide, N,N-dimethylacetamide, tetramethylurea, tetramethylene sulfone and the like. Mixtures of these solvents may also be used. Preferred solvents are diacetone alcohol, isopropanol, dipropylene glycol, 1,3-butanediol, 1,2-pentanediol, diethylene glycol monobutyl ether and tetraethylene glycol monobutyl ether, as well as 1-methyl-2-pyrrolidone.

The thickeners (E) are the customary thickening agents employed in textile dyeing and described in the relevant literature, e.g. in Ullmanns Encyclopädie der technischen Chemie (1951), 7, 80 or 17, 107 or 192. Representative thickeners are: alginates, natural or depolymerised guar flour, carboxymethyl guar, guar phosphate, cationic guar derivatives, and locus bean flour.

Preferred assistants comprise at least the following components:

(Aa) a bisalkylsulfosuccinate containing 8 to 22, preferably 8 to 12, carbon atoms in each of the alkyl moieties, (Bb) a compound of formula $$Y_1—O—(CH_2CH_2O)_m—SO_3\ominus \quad (4)$$

wherein $Y_1$ is $C_8$–$C_{14}$alkyl and m is 2 to 15, preferably 3, (Cc) an amine oxide of formula (3), wherein R is lauryl and $R_1$ is methyl, and (Dd) diacetone alcohol or isopropanol.

In addition to components (Aa), (Bb), (Cc) and (Dd), the novel assistants can also contain water.

The dyeing assistants of this invention preferably comprise, based on the composition 10 to 30% by weight of component (A),
25 to 50% by weight of component (B),
5 to 20% by weight of component (C)
5 to 20% by weight of component (D), and
0 to 55% by weight of water.

The novel dyeing assistants can be prepared by simple stirring of components (A), (B), (C), (D) and, optionally, water and (E) to give clear, homogeneous mixtures which are storage stable at room temperature.

The novel dyeing assistants are particularly useful as low-foaming wetting agents for dyeing synthetic nitrogen-containing fibre materials, preferably textile material made from synthetic polyamide fibres, e.g. from ε-caprolactam, adipic acid and hexamethylenediamine, from ω-aminoundecanoic acid and aromatic polyamide fibres which are derived e.g. from poly(m-phenyleneisophthalimide), and, most preferably, for dyeing polyamide carpets whose fibres may be coated with polytetrafluoroethylene.

Hence the present invention also relates to a process for dyeing or whitening nitrogen-containing fibre materials with dyes or fluorescent whitening agents conventionally employed for such utility, which process comprises dyeing or whitening said fibre material in the presence of the dyeing assistant of the invention.

The amounts in which the dyeing assistant is added to the dyebaths vary from 1 to 20 g per liter of dye liquor.

The fibre materials to be treated by the process of the invention are preferably carpeting materials such as velours or loop pile carpets made of synthetic polyamide.

For treating carpets, it can be convenient to pad the substrate, before dyeing or whitening, with an assistant of this invention comprising components (A), (B), (C) and (D) or a nonionic surfactant, e.g. a $C_8$–$C_{22}$fatty acid alkanolamide or an adduct of 1 to 100 moles of ethylene oxide with 1 mole of a $C_8$–$C_{22}$fatty alcohol or of a $C_4$–$C_{16}$alkylphenol or of a $C_8$–$C_{22}$fatty acid. The substrate is impregnated to a pick-up of 40 to 120% by weight, preferably 50 to 100% by weight. The pretreated substrate is subsequently impregnated with dye liquor to a pick-up of normally 150 to 500% by weight, preferably 200 to 350% by weight. The goods are then subjected to a heat treatment, preferably with steam. The steam treatment is carried out in the temperature range from 98° to 120° C. for 1 to 10 minutes.

Following the heat treatment, the treated fibre material can be given a washing-off to remove non-fixed dye or fluorescent whitening agent or non-fixed finishing agent. This is done by treating the substrate e.g. at 40° to 80° C., in an aqueous liquor or solution which contains soap or a synthetic detergent. Level non-frosted dyeings are obtained by the process of this invention using the dyeing assistant.

Suitable dyes for the process of this invention are customary dyes, e.g. substantive dyes, acid dyes, metal complex dyes, disperse dyes, vat dyes and basic dyes. Anionic dyes are preferred. These dyes are e.g. salts of monoazo, disazo or polyazo dyes which contain heavy metals or are preferably metal-free, including formazane dyes, as well as anthraquinone, xanthene, nitro, triphenylmethane, naphthoquinone-imine and phthalocyanine dyes. The anionic character of these dyes may be imparted by metal complex formation alone and/or preferably by acid salt-forming substituents such as carboxylic acid groups, sulfuric acid ester groups, phosphonic acid ester groups, and phosphonic acid groups or sulfonic acid groups. These dyes may also contain in the molecule reactive groups which form a covalent bond with the substrate to be dyed. Preferred dyes are the acid metal-free dyes. These preferably contain only a single sulfonic acid group.

Useful dyes are also the 1:1 or 1:2 metal complex dyes. The 1:1 metal complex dyes contain preferably one or two sulfonic acid groups. As metal they contain a heavy metal atom, e.g. copper, nickel or, preferably, chromium. Preferred metal complex dyes are 1:2 cobalt or 1:2 chromium complexes of monoazo dyes which contain acid amide or alkylsulfonyl groups or altogether a single sulfonic acid group.

Mixtures of at least two or three dyes can also be used in the process of this invention to produce level and strong combination shade dyeings, including dichromatic or trichromatic dyeings. Trichromatic dyeing will be understood as meaning, in particular, a combination of the three basic colours: yellow (or orange), red and blue. A very useful blue component is, in particular, at least one dye of formula

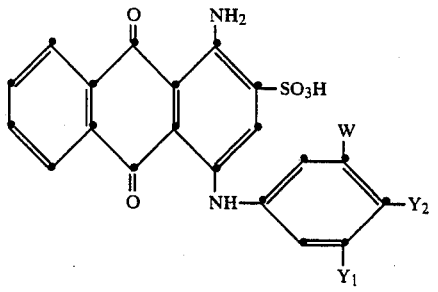

(5)

wherein W is hydrogen or methyl and one of $Y_1$ and $Y_2$ is $C_2$–$C_4$alkanoylamino or $C_2$–$C_4$hydroxyalkylsulfamoyl and the other is hydrogen or methyl; and, preferably, a dye of formula

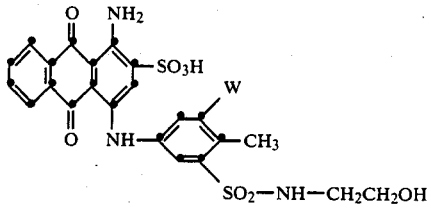

(6)

wherein W is hydrogen or preferably methyl; or a mixture of the dye of the formula (6) and a dye of formula

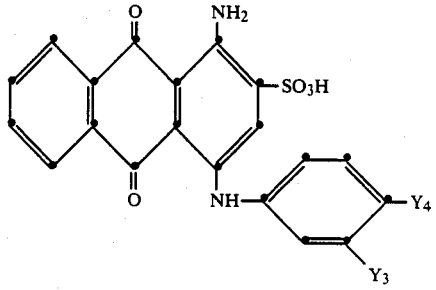

(7)

wherein one of $Y_3$ and $Y_4$ is acetylamino or, preferably, propionylamino, and the other is hydrogen. The dyes of formulae (5), (6) or (7) are in the form of the free acids or, preferably, of salts, e.g. alkali metal salts or ammonium salts. The ratio of the dye of formula (6) to that of formula (7) is preferably 80:20 to 20:80, most preferably 60:40 to 40:60.

Examples of dyes eligible for use in the process of the invention are also described in the Colour Index, 3rd edition, 1971, Vol. 4.

The assistants can also be used for whitening undyed fibre materials with fluorescent whitening agents. The fluorescent whitening agents can belong to the stilbene, pyrazoline, triazolyl or benzoxazolyl series.

Suitable fabric finishing agents which can be applied in the process of this invention are all chemical finishing agents which are suitable for use in the textile field, such as conditioning agents, binders, fabric softeners, cleansing agents and sizing agents. It is possible to apply e.g. flame retardants, water repellents, oil repellents, anticrease agents, easy-care agents, stiffeners, antisoil or soil release agents and antistatic agents.

The treatment liquors can also contain conventional additives, preferably electrolytes such as salts, e.g. sodium sulfate, ammonium sulfate, sodium or ammonium phosphates or sodium or potassium polyphosphates, ammonium acetate or sodium acetate and/or acids, e.g. mineral acids such as sulfuric acid or phosphoric acid, or organic acids, preferably lower aliphatic carboxylic acids such as formic, acetic or oxalic acids. The acids are employed principally for adjusting the pH value of the liquors to be used in the process of this invention. Depending on the substrate to be treated, the pH is usually in the range from 5 to 8.

Depending on the desired effect, the treatment liquors can contain still further additional ingredients such as catalysts, urea, oxidants, solvents, retardants, dispersants or emulsifiers.

The dyebaths containing the assistants can be applied uniformly to the fibre materials by a wide range of application techniques. Examples of some techniques are: impregnation by the coating method, vacuum penetration, rolling on, suction, doctor coating with fixed or revolving blades (on one or both sides), padding, blowing in, compressing, immersing and slop-padding.

In contradistinction to prewetting with strong wetting agents, as is customary when using conventional padding assistants, the prewetting of the fibre material with the assistants of this invention does not result in strong retarding effects.

In the following Examples, parts and percentages are by weight unless otherwise indicated.

EXAMPLE 1

A polyamide 6,6 carpet, which is wetted with water and pinched-off to a pick-up of 100%, is impregnated to a pick-up of 300% by coating with an aqueous liquor containing 1.2 g/l of a dye of formula

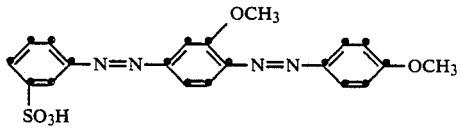

(1A)

0.8 g/l of a dye of formula

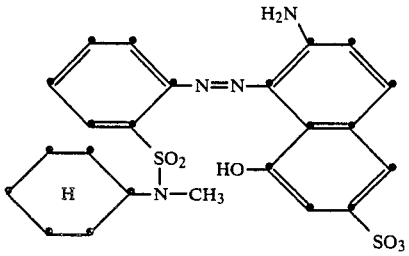

(1B)

0.2 g/l of a dye of formula

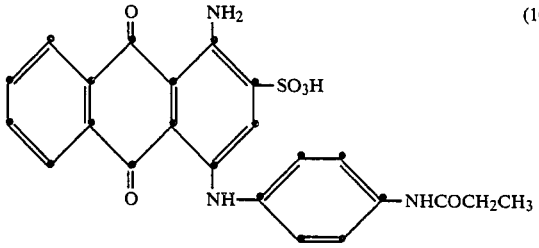

(1C)

0.08 g/l of a dye of formula

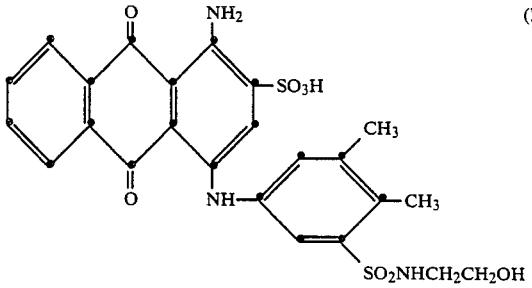

(ID)

0.45 g/l of bisoctyl sulfosuccinate (sodium salt)
1.25 g/l of sodium lauryl triglycol ether sulfate
0.22 g/l of lauryl dimethylamine oxide
0.30 g/l of diacetone alcohol
2.00 g/l of a thickener, e.g. carboxymethyl guar
1.00 g/l of sodium acetate, and
acetic acid for adjusting the liquor to pH 5.5.

The carpet is then treated with saturated steam at 100° C. for 5 minutes and thereafter rinsed with water of 80° C. and dried at 100° C. on a cylindrical sieve drier. A level, non-frosting beige dyeing is obtained.

EXAMPLE 2

A polyamide 6,6 carpet coated with Teflon (e.g. with Antron ® Plus, ex Du Pont) is prewetted on a jet bulker at 70° C. in an aqueous liquor containing 1 g/l of the adduct of 9 moles of ethylene oxide and 1 mole of nonylphenol, and centrifuged to a pick-up of 50%.

The carpet is theen impregnated to a pick-up of 350% with an aqueous liquor comprising
1.50 g/l of a dye of formula (1A)
1.50 g/l of a dye of formula (1C)
0.60 g/l of a dye of formula (1D)
0.30 g/l of bisoctyl sulfosuccinate (sodium salt)
0.83 g/l of sodium lauryl triglycol ether sulfate
0.15 g/l of lauryl dimethylamine oxide
0.20 g/l of diacetone alcohol, and
acetic acid for adjusting the pH to 5.5.

The carpet is then passed through a horizontal steamer at 10 m/minute and treated with saturated steam for 4 minutes. The carpet is then rinsed and dried. A level, green dyeing is obtained.

Comparable level dyeings are obtained by using 1,2-pentanediol, diethylene glycol monobutyl ether or tetraethylene glycol monobutyl ether, dipropylene glycol or 1-methyl-2-pyrrolidone instead of diacetone alcohol in Examples 1 and 2.

What is claimed is:

1. A dyeing assistant for dyeing or whitening synthetic nitrogen-containing fibre materials, which assistant comprises (A) 10 to 30% by weight of a bisalkyl sulfosuccinate or sulfosuccinamide, (B) 25 to 50% by weight of an anionic surfactant, (C) 5 to 20% by weight of an amine oxide of the formula

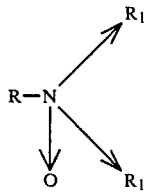

wherein R is $C_8$–$C_{22}$alkyl and $R_1$ is $C_1$–$C_4$alkyl, (D) 5 to 20% by weight of a water-soluble organic polar solvent selected from the group consisting of an aliphatic $C_1$–$C_6$-alcohol, an alkylene glycol, a monoalkyl ether of a glycol, a ketone, an ether, an acetal, pyridine, acetonitrile, γ-butyrolactone, N,N-dimethylformamide, N,N-dimethylacetamide, tetramethylurea and tetramethylene sulfone, and 0 to 55% by weight of water.

2. An assistant according to claim 1 which contains water.

3. An assistant according to claim 2, which additionally comprises a thickener as component (E).

4. An assistant according to claim 1, wherein component (B) is an acid ester, or a salt thereof, of a polyadduct of 2 to 30 moles of ethylene oxide with 1 mole of a $C_8$–$C_{22}$fatty alcohol.

5. An assistant according to claim 4, wherein component (B) is a compound of formula $$Y—O—(CH_2CH_2O—)_mX,$$

wherein Y is $C_8$–$C_{22}$alkyl, X is the sulfuric acid radical and m is 2 to 15.

6. An assistant according to claim 1, wherein component (D) is diacetone alcohol, isopropanol, dipropylene glycol, 1,3-butanediol, 1,2-pentanediol, diethylene glycol monobutyl ether, tetraethylene glycol monobutyl ether, or 1-methyl-2-pyrrolidone.

7. A process for dyeing or whitening synthetic nitrogen-containing fibre material which comprises dyeing or whitening said material in the presence of an assistant comprising (A) 10 to 30% by weight of a bisalkyl sulfosuccinate or sulfosuccinamide, (B) 25 to 50% by weight of an anionic surfactant, (C) 5 to 20% by weight on an amine oxide of the formula

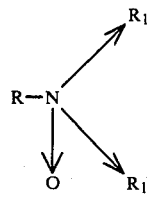

wherein R is $C_8$–$C_{22}$alkyl and $R_1$ is $C_1$–$C_4$alkyl, (D) 5 to 20% by weight of a water-soluble organic polar solvent selected from the group consisting of an aliphatic $C_1$–$C_6$-alcohol, an alkylene glycol, a monoalkyl ether of a glycol, a ketone, an ether, an acetal, pyridine, acetonitrile, γ-butyrolactone, N,N-dimethylformamide, N,N-dimethylacetamide, tetramethylurea and tetramethylene sulfone, and 0 to 55% by weight of water.

8. A process according to claim 7, wherein the assistant is used in an amount of 1 to 20 g per liter of dye liquor.

9. A process according to claim 8, wherein the dyeing or whitening is carried out in the pH range from 5 to 8.

10. A process according to claim 7, which comprises whitening the fibre material with a fluorescent whitening agent selected from the stilbene, pyrazoline, triazolyl or benzoxazolyl series.

* * * * *